US009091244B2

(12) United States Patent
Trump et al.

(10) Patent No.: US 9,091,244 B2
(45) Date of Patent: Jul. 28, 2015

(54) METHOD FOR MONITORING THE COMBUSTION CHAMBER OF A CYCLICALLY OPERATING COMBUSTION ENGINE

(71) Applicant: BorgWarner BERU Systems GmbH, Ludwigsburg (DE)

(72) Inventors: Martin Trump, Stuttgart (DE); Steffen Bohne, Freiburg (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 265 days.

(21) Appl. No.: 13/902,293

(22) Filed: May 24, 2013

(65) Prior Publication Data

US 2013/0319384 A1 Dec. 5, 2013

(30) Foreign Application Priority Data

May 30, 2012 (DE) ..... 10 2012 104 642

(51) Int. Cl.

| | |
|---|---|
| ***F02P 3/00*** | (2006.01) |
| ***F02P 3/01*** | (2006.01) |
| ***F02P 23/04*** | (2006.01) |
| *F02P 17/12* | (2006.01) |

(52) U.S. Cl.

CPC ... *F02P 3/00* (2013.01); *F02P 3/01* (2013.01); *F02P 23/04* (2013.01); *F02P 17/12* (2013.01)

(58) Field of Classification Search

CPC ..... F02P 3/00; F02P 3/005; F02P 3/01; F02P 3/06; F02P 3/09; F02P 17/12; F02P 2017/125; F02P 2017/126; F02P 2017/127

USPC ..... 123/623

See application file for complete search history.

(56) References Cited

U.S. PATENT DOCUMENTS

2011/0114071 A1* 5/2011 Freen ..... 123/623
2011/0305998 A1 12/2011 Toedter et al.

FOREIGN PATENT DOCUMENTS

| | | | |
|---|---|---|---|
| DE | 10 2005 036 968 | A1 | 2/2007 |
| DE | 10 2009 013 877 | A1 | 9/2010 |
| DE | 10 2010 024 396 | A1 | 11/2011 |
| WO | WO 2010/011838 | A1 | 1/2010 |
| WO | WO 2012/138676 | A1 | 10/2012 |

* cited by examiner

*Primary Examiner* — Lindsay Low
*Assistant Examiner* — Jacob Amick
(74) *Attorney, Agent, or Firm* — Bose McKinney & Evans LLP

(57) ABSTRACT

The present invention relates to a method for monitoring the combustion chamber of a cyclically operating combustion engine in which an air-fuel-mixture is ignited by means of a corona discharge generated by an electrical oscillating circuit in which an ignition electrode, which is electrically isolated from the combustion chamber walls, and the combustion chamber walls form a capacitor, wherein by evaluating an electrical parameter of the oscillating circuit information about the combustion chamber is gained. The voltage exciting the oscillating circuit is reduced after the beginning of the combustion and the oscillating circuit is then excited with a reduced voltage.

17 Claims, 2 Drawing Sheets

METHOD FOR MONITORING THE COMBUSTION CHAMBER OF A CYCLICALLY OPERATING COMBUSTION ENGINE

RELATED APPLICATIONS

This application claims priority to DE 10 2012 104 642.5, filed May 30, 2012, which is hereby incorporated by reference in its entirety.

BACKGROUND

The present invention relates to a method of monitoring the combustion chamber of a cyclically operating combustion engine in which an air-fuel-mixture is ignited by means of a corona discharge generated by exciting an electrical oscillating circuit.

Ignition devices in which an air-fuel-mixture is ignited by a corona discharge comprise an oscillating circuit in which the ignition electrode, electrically isolated from the combustion chamber walls, and the combustion chamber walls form a capacitor. Exciting the oscillating circuit leads to a corona discharge at the ignition electrode which then ignites the air-fuel mixture in the combustion chamber. Such a device for corona ignition is described for example in WO 2010/011838. The content of the combustion chamber is the dielectric medium of the capacitor between the ignition electrode and the combustion chamber walls. Evaluating the electrical parameters of this oscillating circuit, for example its resonance frequency, its impedance or its phase shift between current and voltage, allows the characterization of the condition of the combustion chamber and determining for example the combustion state.

SUMMARY

The present invention presents a way to obtain better information about the condition of the combustion chamber content by using a corona ignition device.

In a method according to this disclosure, the oscillating circuit is excited with a reduced voltage after the beginning of the combustion. Even when excited with only a reduced voltage, evaluating the development of the electrical parameters of this oscillating circuit, for example its resonance frequency, its impedance or its phase shift between current and voltage, allows obtaining information about the combustion chamber, for example obtaining a parameter that characterizes the condition of the combustion chamber and/or the state of the mixture in the combustion chamber. With a method according to this disclosure, the combustion chamber can be monitored during a longer period without excessive wear and tear of the electronics of the corona ignition device and without adversely affecting the combustion itself.

In conventional methods the corona ignition device is switched off after the beginning of the combustion, so that the oscillating circuit is not excited any more until a new ignition of the corona discharge takes place. In a method according to this disclosure, the oscillating circuit is excited even after the beginning of combustion, but with a lower voltage, that can be for example less than half as high as the voltage at the beginning of the combustion.

The reduced voltage may be high enough to sustain the corona discharge with reduced magnitude. Preferably the voltage is set too small to cause and/or sustain a corona discharge. This means that preferably the oscillating circuit is excited with a reduced voltage when the corona discharge is extinct.

As it can be difficult to determine exactly the beginning of combustion, the corona discharge is usually sustained for a more or less short period after the beginning of combustion. In a method according to this disclosure, therefore a longer or shorter period of time will elapse between the beginning of combustion and the reduction of the voltage exciting the oscillating circuit. Preferably the reduction of the voltage happens during the power stroke.

Some improvement can already be achieved by exciting the oscillating circuit with reduced voltage for a short while after the point in time when the corona discharge is extinguished in conventional methods. An advantageous refinement provides that the oscillating circuit is excited with reduced voltage at least for a time interval in which the crank shaft moves by an angle of at least 60°.

Data of the combustion chamber during the power stroke are of special interest for engine control. An advantageous refinement of this disclosure therefore provides that the oscillating circuit is excited for more than half of the duration of a power stroke. During a part of this time, the oscillating circuit may be excited by the higher voltage that also excites the oscillating circuit at the beginning of combustion. During another part of this time, the oscillating circuit can be excited with the reduced voltage. Preferably the oscillating circuit is excited with reduced voltage during more than two thirds of the power stroke, for example during more than three quarters or during the whole period of the power stroke.

Preferably the method is applied in a four stroke engine, but it can also be applied in a two stroke engine. Four stroke engines have an intake stroke, a compression stroke, a power stroke and an exhaust stroke.

An advantageous refinement of this disclosure provides that the oscillating circuit of a corona ignition device is excited at least during two thirds of the compression stroke, particularly preferred at least during three quarters of the compression stroke, for example during the whole compression stroke. In addition to the power stroke, the compression stroke is also of great importance for an optimal combustion. By monitoring the combustion chamber during the major part of the compression stroke or even during the whole compression stroke, for example by measuring the development of the pressure in the combustion chamber, engine control can therefore be improved. The oscillating circuit of the corona ignition device can also be excited during the whole operation cycle of the engine thus enabling continuous monitoring of the combustion chamber.

Usually corona ignition devices comprise a voltage transformer generating a higher secondary voltage from a primary voltage. This secondary voltage then excites the oscillating circuit. The voltage exciting the oscillating circuit usually equals the voltage at the ignition electrode. Creating a corona discharge for the ignition of an air-fuel-mixture usually requires the full board voltage or even a higher voltage of some ten volts generated for example by capacitors or a pre-stage of a voltage transformer. Providing the reduced alternating voltage only requires a significantly lower primary voltage, that is less than half of that, usually even less than a quarter of the primary voltage needed for starting a corona discharge, for example only 5 V to 10 V.

In a method according to this disclosure, an alternating voltage can be induced at the ignition electrode by exciting the oscillating circuit. During a first period that alternating voltage may exceed a minimum value to ignite the corona discharge. During a second period the alternating voltage may be lowered to less than half of that minimum value to monitor the combustion chamber. Said in other words, the alternating voltage at the ignition electrode during the second period in which the oscillating circuit is only excited for monitoring the combustion chamber and in which no corona discharge burns is only less than half of the value during the first period in which the corona discharge burns to ignite the air-fuel-mixture.

Preferably the alternating voltage at the ignition electrode should be less than a quarter of this minimum value, particularly preferred less than an eighth of this minimum value.

This minimum value, which the alternating voltage applied to the ignition electrode exceeds during the first period, can be determined favorably in relation to the breakdown voltage. The breakdown voltage is the voltage at which a corona discharge turns into an arc discharge. Preferably the minimum value should be at least two thirds of the breakdown voltage. During the first period the alternating voltage applied to the ignition electrode then has a value between two thirds of the breakdown voltage and the breakdown voltage itself. In this way a large corona discharge is achieved for igniting the air-fuel-mixture in the combustion chamber and thus a high amount of energy is brought into the air-fuel-mixture. Particularly preferred, the minimum value should be at least three quarters, for example at least four fifths of the breakdown voltage. The breakdown voltage may change during the operation cycle of the engine. If this change is significant, the minimum value can be re-defined in relation to the lowest value of the breakdown voltage, for example with the above mentioned parameters.

The alternating voltage that is applied during the first period to the ignition electrode for igniting the air-fuel-mixture can, for example, be determined by the method described in DE 10 2010 024 396 A1.

Preferably the second period should be at least as long as the first period. As the alternating voltage exciting the oscillating circuit and therefore also the alternating voltage at the ignition electrode cannot change instantly, there will be a longer or shorter length of time between the first and the second period in which the value of the alternating voltage at the ignition electrode lies between the minimum value of the first period and the maximum value of the second period. Particularly preferred the second period should be at least twice as long as the first period.

For igniting air-fuel-mixture, the corona discharge must transmit a significant amount of energy into the combustion chamber. Conventional corona ignition devices usually effect this transmission of energy when the crank shaft angle is within a range from 60° before the upper dead center of ignition up to 20° after the upper dead center of ignition. Preferably the first period should be within that range. For example, the first period should not begin earlier than at 90° before the upper dead center of ignition, preferably not earlier than at 60° before the upper dead center of ignition. In addition, the first period should begin at the latest at 30° before the upper dead center of ignition, preferably no later than at 40° before the upper dead center of ignition. Preferably the first period should not end before the upper dead center of ignition, particularly preferred not before 10° after the upper dead center of ignition. Preferably the first period should end no later than at 60° after the upper dead center of ignition, particularly preferred at the latest at 40° after the upper dead center of ignition.

An advantageous refinement provides that the oscillating circuit is a phase locked loop comprising a voltage controlled oscillator and that the voltage of this oscillator is the electrical parameter that is evaluated to get information about the combustion chamber. The voltage of this oscillator is a reference for the frequency and can easily be measured in order to get the electrical parameter of the oscillating circuit enabling monitoring the combustion chamber with a minimum of effort.

BRIEF DESCRIPTION OF DRAWINGS

More details and advantages of this disclosure will be given below in the embodiments together with the enclosed figures. Components that are equal or that correspond to one another are provided with the same reference signs.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
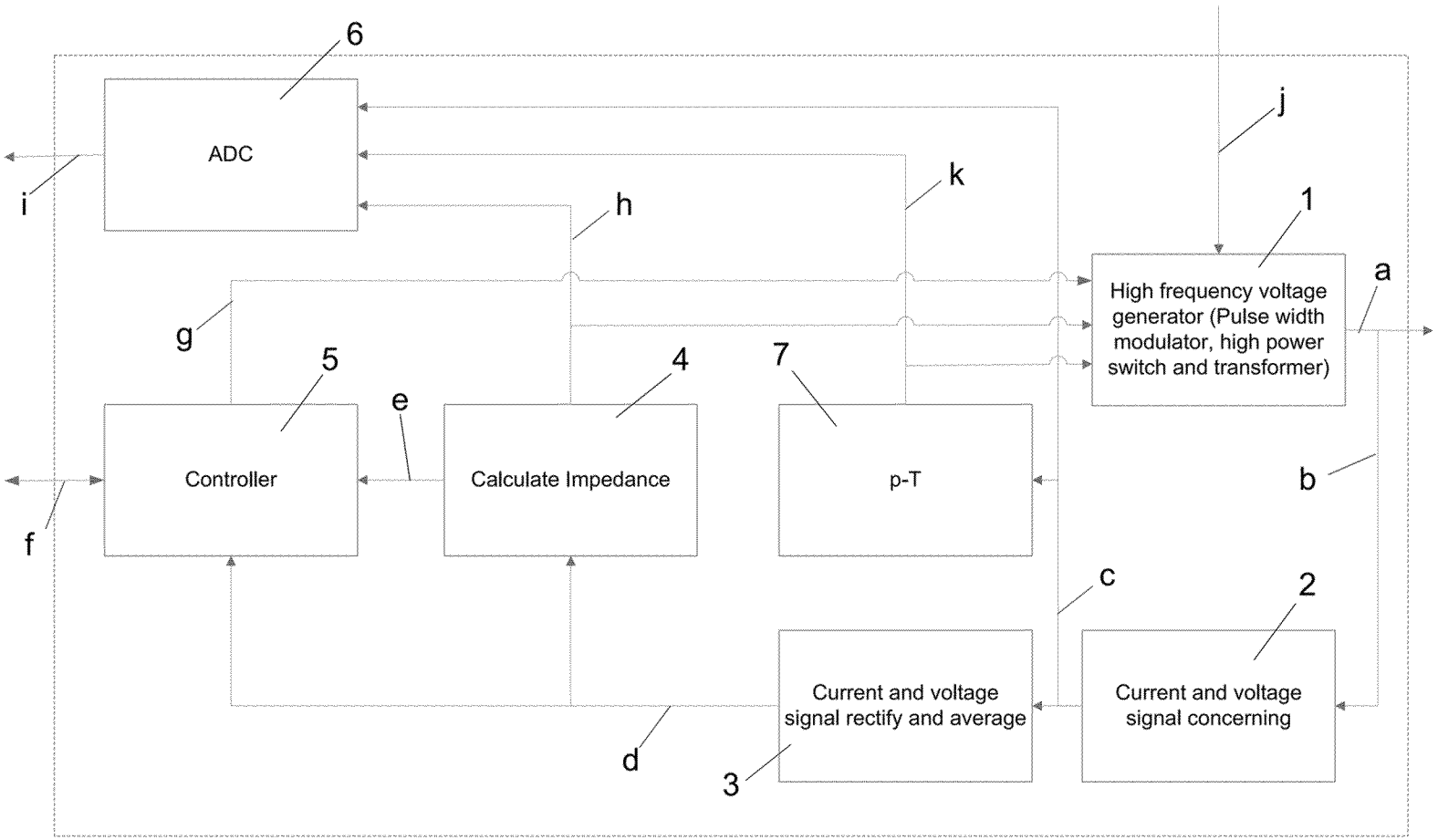
FIG. 1 shows a block diagram of a first example of a corona ignition device.

FIG. 1 shows a schematical block diagram of an open-loop phase controlled corona ignition device. An alternating voltage is provided by a high frequency voltage generator 1. This voltage excites an oscillating circuit of the corona ignition device (not shown) and is applied to an ignition electrode via line a. Measured values of this alternating voltage and the corresponding alternating current are transferred to a filter unit 2 via the signal line b. In the filter unit 2 the values of voltage and current can be cleaned from noise and interferences before they are transferred via line c to a rectifier 3, to a phase locked loop 7 and to an analog-digital-converter 6 monitoring the combustion chamber.

The filter unit 2 may be a low pass filter. If the signal line b transmits high frequency raw signals, 20 MHz for example may be appropriate as threshold value for the low pass filter. If the signal line b transmits effective values, 500 kHz for example may be appropriate as threshold value for the low pass filter.

From the rectifier 3 the signals will be transmitted via line d to a divisor 4 which calculates the impedance of the oscillating circuit on the basis of the filtered voltage and current signals. The impedance values will be supplied via line e to a control device 5, for example a microprocessor. Control device 5 will also be fed with values of current and voltage via line d. The control device 5 can deduce control deviations from these values and transmit arithmetic results for control to the high frequency voltage generator 1 via line g. The control device 5 can communicate with an engine controller via the in- and output interface f and thus can receive for example control commands or target values.

The target frequency of the high frequency voltage generator 1 is set by the phase locked loop 7. The frequency of the high frequency voltage generator 1 is controlled so that the phase difference between the alternating current in the oscillating circuit and the alternating voltage exciting the oscillating circuit is as small as possible. The phase locked loop 7 includes a voltage controlled oscillator "VCO." The voltage of this oscillator is proportional to the frequency and provided via line k to the analog-digital-converter 6. The analog-digital-converter 6 also receives via line h the impedance determined by the divisor 4.

The analog-digital-converter 6 can thus provide different electrical parameters of the oscillating circuit on the output interface i: the impedance of the oscillating circuit, the frequency of the oscillating circuit, the alternating current, the alternating voltage, and their phase shift. Actually, a single parameter would be enough for monitoring the combustion chamber. Evaluating more parameters will improve monitoring and redundancy will enhance reliability. Important information can be deduced by the respective absolute values of the electrical parameters as well as from their change over time. For evaluation it can therefore be favorable to calculate their time derivative or their integral.

These parameters can also be provided analogous on an output interface.

Parameters characterizing the condition of the combustion chamber can be determined from these electrical parameters or their changes over time. Parameters characterizing the condition of the combustion chamber are the pressure in the combustion chamber, or the state of the mixture in the combustion chamber, for example. The embodiment shown is designed to evaluate the electrical parameters of the combustion chamber externally, for example in an engine control device. The evaluation can also be made by the corona ignition device itself, for example by control device 5, so that the engine control device can be provided with parameters of the combustion chamber.

Figure 2:
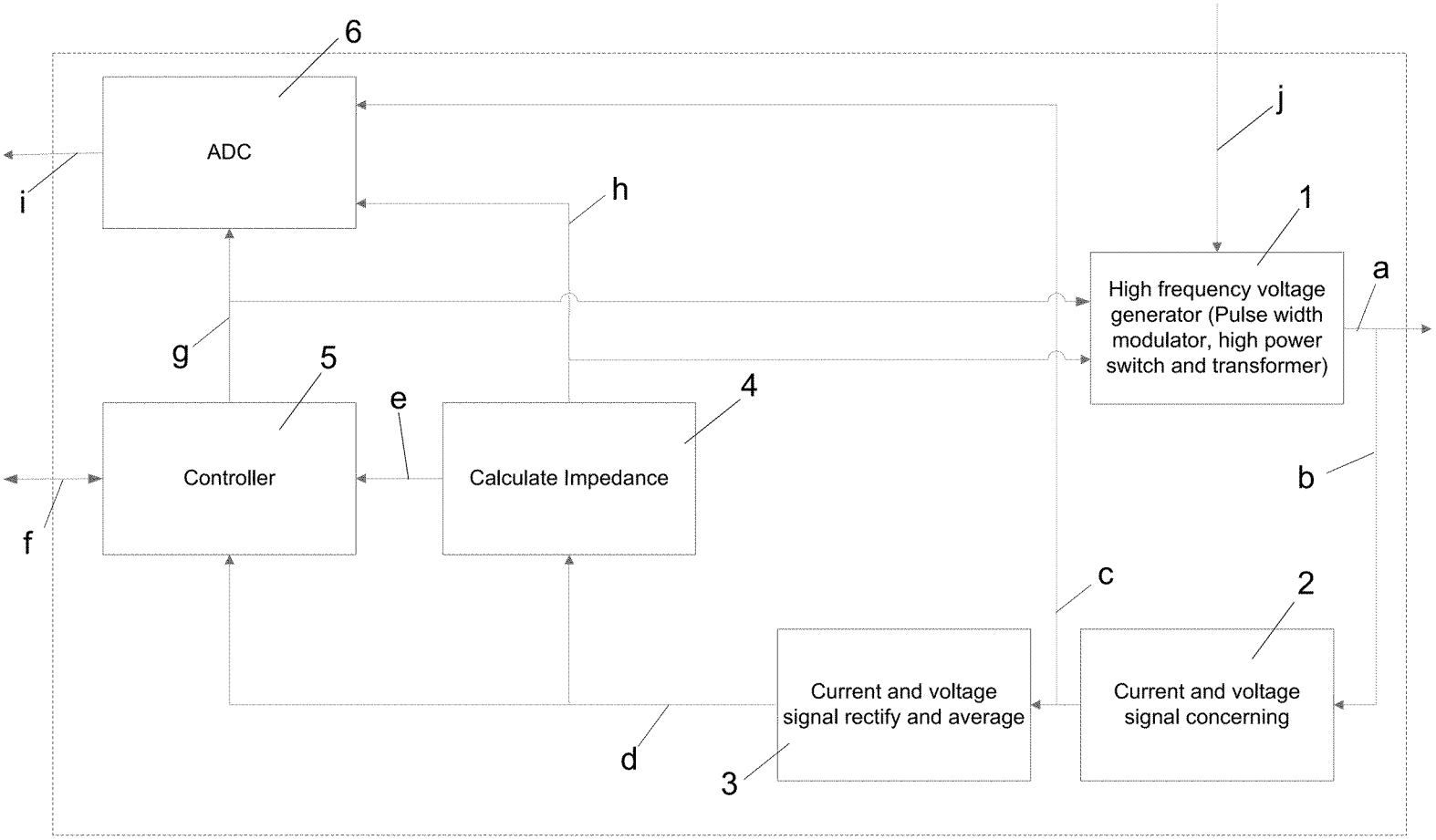
FIG. 2 shows a block diagram of a second example of a corona ignition device.

FIG. 2 shows a schematical block diagram of a closed-loop phase controlled corona ignition device. This block diagram is quite similar to the other block diagram. For this reason only the differences between both will be mentioned in the following.

The closed-loop phase controlled corona ignition device of FIG. 2 does not include a phase locked loop 7. Hence, the high frequency voltage generator 1 is controlled by the control device 5 via line g, for example by setting a target value of the impedance or an error signal, determined by comparison of the target value and the actual value of the impedance.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for monitoring a combustion chamber of a cyclically operating combustion engine, comprising:

generating a corona discharge by exciting an electrical oscillating circuit in which an ignition electrode, which is electrically isolated from the combustion chamber walls, and the combustion chamber walls constitute a capacitor;

igniting an air-fuel-mixture with the corona discharge;

evaluating an electrical parameter of the oscillating circuit and thereby obtaining information about the combustion chamber; and after the beginning of combustion, reducing the voltage that excites the oscillating circuit and then exciting the oscillating circuit with a reduced voltage, wherein the oscillating circuit is excited with the reduced voltage while the corona discharge is extinct.

2. The method according to claim 1, wherein the reduced voltage is less than half of the value at the beginning of the combustion.

3. The method according to claim 1, wherein the oscillating circuit is excited with the reduced voltage at least during a time interval in which the crank shaft angle changes by at least 60°.

4. The method according to claim 1, wherein the oscillating circuit is excited during more than half of the power stroke.

5. The method according to claim 1, wherein the oscillating circuit is excited during more than three quarters of the power stroke.

6. The method according to claim 1, wherein the oscillating circuit is excited during the entire power stroke.

7. The method according to claim 1, wherein the oscillating circuit is excited by an alternating voltage which during a first period exceeds a minimum value to ignite the corona discharge and during a second period after the beginning of the combustion decreases to less than the half of that minimum value to monitor the combustion chamber.

8. The method according to claim 7, wherein during the second period after the beginning of the combustion the alternating voltage decreases to less than a quarter of that minimum value.

9. The method according to claim 7, wherein during the second period after the beginning of the combustion the alternating voltage decreases to less than an eighth of that minimum value.

10. The method according to claim 7, wherein the minimum value is at least two thirds of the breakdown voltage at which the corona discharge turns into an ark discharge.

11. The method according to claim 7, wherein the minimum value is at least three quarters of the breakdown voltage at which the corona discharge turns into an ark discharge.

12. The method according to claim 7, wherein the minimum value is at least four fifths of the breakdown voltage at which the corona discharge turns into an ark discharge.

13. The method according to claim 7, wherein the second period is at least as long as the first period.

14. The method according to claim 7, wherein the second period is at least twice as long as the first period.

15. The method according to claim 7, wherein the first period begins at the earliest at 90° before the upper dead center of ignition.

16. The method according to claim 7, wherein the first period begins at the earliest at 60° before the upper dead center of ignition.

17. The method according to claim 1, wherein the oscillating circuit is a phase locked loop comprising a voltage controlled oscillator and wherein the voltage of this oscillator is the electrical parameter that is evaluated to obtain information about the combustion chamber.

* * * * *